US005312218A

United States Patent [19]

Pratt et al.

[11] Patent Number: 5,312,218

[45] Date of Patent: May 17, 1994

[54] FOLDING APPARATUS FOR POSITIONING OBJECTS INTO STRUCTURES

[76] Inventors: Rodger D. Pratt, 5436 106th NE., Kirkland, Wash. 98033; Michael J. Sparling, 14011 117th Pl. NE., Kirkland, Wash. 98034

[21] Appl. No.: 895,740

[22] Filed: Jun. 9, 1992

[51] Int. Cl.[5] ..... B66C 1/22

[52] U.S. Cl. ..... 414/10; 414/11; 414/673; 294/67.1; 294/67.21; 294/67.5; 294/81.3; 187/2

[58] Field of Search ..... 414/10, 11, 592, 608, 414/667, 671, 673; 294/67.1, 67.2, 67.21, 67.5, 81.1, 81.3; 187/2

[56] References Cited

U.S. PATENT DOCUMENTS

| | | | |
|---|---|---|---|
| 1,775,956 | 9/1930 | Fullerton | 294/67.1 X |
| 3,341,243 | 9/1967 | Archer | 294/67.21 |
| 3,405,665 | 10/1968 | Slonim | 294/67.1 X |
| 3,762,755 | 10/1973 | Saether | 294/81.3 X |
| 4,671,721 | 6/1987 | Pratt et al. | 414/10 |

FOREIGN PATENT DOCUMENTS

| | | | |
|---|---|---|---|
| 266339 | 3/1989 | Fed. Rep. of Germany | 294/67.1 |
| 33245 | 3/1977 | Japan | 414/671 |
| 75659 | 7/1978 | Japan | 294/67.2 |
| 872429 | 10/1981 | U.S.S.R. | 294/67.21 |
| 1507718 | 9/1989 | U.S.S.R. | 294/67.21 |
| 2129766 | 5/1984 | United Kingdom | 294/67.1 |

*Primary Examiner*—Michael S. Huppert
*Assistant Examiner*—Stephen Gordon
*Attorney, Agent, or Firm*—Mark Zovko

[57] ABSTRACT

Apparatus for lifting objects into preformed openings in buildings. These openings can be recessed. The apparatus has a frame which has a head section and a tail section. The head section and tail section are rotably mounted to each other. A backstand is provided which is attached to the head section for preventing the objects to be lifted from moving as the objects are transported. Supports or forks are also provided which protrude from the head section and are used to support the objects to the transported. The apparatus has a leveling system which includes movable counterweights attached to chains. The movable counterweights balance the effect of the objects that the apparatus supports, keeping it level in the horizontal direction. The backstand can be folded down into the head section and the tail section folded onto the head section. Prior to or after use, as the apparatus is a lightweight, compact system, it can be transported in a pickup truck.

18 Claims, 4 Drawing Sheets

FOLDING APPARATUS FOR POSITIONING OBJECTS INTO STRUCTURES

BACKGROUND OF THE INVENTION

I. Field of the Invention

The invention relates in general to apparatus for lifting objects into a structure and, more particularly, to a folding, lightweight apparatus that easily can assist in lifting panels or the like into preformed openings of a building under construction.

II. Description of the Prior Art

Modern tall office buildings are generally constructed as a shell with openings for panels and windows or the like. Buildings of this type can reach heights of 70 stories. The shell of the building is constructed with openings. Precast or prefabricated panels are then placed within these openings. These construction panels are of various sizes, shapes and thicknesses. Precast panels are made of reinforced concrete and may have heights as tall as 10 feet and lengths to 20 feet. These thicknesses may vary from 3 to 12 inches. Reinforced concrete panels with dimensions of this order are extremely heavy. Maneuvering of such heavy reinforced concrete panels is therefore difficult. The openings for receiving such a concrete panel may be at or above the 10th story making it necessary to lift panels to the 10th story or higher, and place them within the openings. Ordinarily, cranes are used to lift the panel up to the openings. The cranes may be situated on the ground or as the number of stories of the building increases, it is necessary to position the crane on the top floor of the building as it is being constructed or use a tower crane. A further complication arises in the construction of modern concrete steel buildings in that spandral beams are required. These spandral beams are so constructed that the openings for precast concrete panel may be as much as 3 feet inside the face of the spandral beam. The spandral beam therefore functions as a hindrance to the insertion of the precast concrete panel into the opening of the building. Without going into unnecessary detail, it is well known that the spandrals are required. The spandrals are required to be in place before the precast concrete panels are fit into the opening. Normally, the method of installing a panel of this type in the recessed opening in the building would be to attach lifting rings to the top of the panel. The rings would be attached with suitable bolts and a crane would be hooked to the lifting ring to lift the precast panel to the desired height in the building. Once the panel is lifted in close proximity to the opening it is to be fit into, construction workers will begin attempting to grab the panel and pull the panel into the opening. It is to be appreciated that the panel is large and heavy and the workers must manually pull the panel into the opening. After the panel has been pulled into the opening, it must be secured in place within the opening. The panel may be secured in place by bolting the panel to the structure in the building, welding the panel to the building, or by other suitable means. This procedure has obvious shortcomings. These shortcomings include the amount of time that workers take to fit one panel in place, and also due to the awkwardness of grabbing and fitting the panel in the opening, the possibility of an accident involving the workers.

U.S. Pat. No. 4,671,721 issued to applicants on Jun. 9, 1987, addressed the problems previously outlined above. In this embodiment, an apparatus and method for positioning an object in a building was disclosed. This invention showed that precast panels can be delivered to openings in office buildings in a controlled manner which facilitated placing the panels in the building. The invention had many advantages over the prior art. On the other hand, the invention had a shortcoming in that the apparatus used to lift the panels was of itself extremely bulky and heavy. Although this shortcoming did not necessarily affect the performance of what can be described as "the flying forklift," it did affect its use in construction sites as transportation of the apparatus to and from various sites became a major drawback. Put simply, it would be desirable to have an apparatus that can be transported by a pickup truck as opposed to other more costly methods, and still make installation of precast panels or the like in openings in a building easier and safer than had been in the prior art. Applicants have therefore come up with a new apparatus which fulfills all the desired requirements, as shown in U.S. Pat. No. 4,671,721 and has further advantages in its use and transportation as will become clear from the specification herein.

SUMMARY OF THE INVENTION

This invention describes an apparatus for lifting loads such as precast concrete panels into openings in a structure under construction. The invention can be used by a lifting device such as a crane and would be located between the load line of the lifting device and the panel to be elevated. The apparatus is constructed such that the objects lifted can be offset at various distances with respect to the load line of the lifting device and therefore can be positioned within recessed openings of the structure in a controlled and safe manner. The apparatus has a frame which has two sections: a head section and a tail section. The tail section is mounted to the head section in such a manner that the head section can be folded over the tail section prior to the use of the apparatus. In practice, the head section and the tail section would be of approximately equal lengths. The head section, however, would be wider than the tail section. The head section also includes a backstand attached thereto. The backstand is used as a support for the objects being lifted to prevent those objects from moving forward on the apparatus. The backstand has a substantially vertical member which can be called a first vertical member and a second support member attached at one end to the top of the vertical member and at the other end to the head section itself. Outwardly directed supports are provided which protrude outwardly from the head section. Supports or forks are secured to the head section and are for receiving and supporting the objects to be lifted. The apparatus also includes a leveling system mounted on the frame for leveling the frame horizontally when the forks receive objects to be lifted. The leveling system includes a movable counterweight attached by chains to a motor which is used to keep the frame level as objects are transported. It also should be noted that the vertical and support members of the backstand can be disconnected from each other and folded down over the head section. The supports for the objects to be carried or forks, as they are called, can be disconnected from the head section when not in use and secured thereto for transportation, thus minimizing the dimensions of the entire apparatus package when it is not in use. Preferably, the entire apparatus can be made of a lightweight structural material such as aluminum, and in fact is in practice lighter than the objects that will be transported by the apparatus. Besides the advantages of the apparatus in positioning objects inside recessed openings in a structure, it further has the desirable feature of being compact and lightweight. These qualities allow easy and rapid transportation of the apparatus which is highly desirable for its use on construction sites and allows use of this apparatus with substantially lighter capacity lifting devices. When the apparatus is transported, its dimensions have been minimized to further this end of rapid and easy transportation. This makes the apparatus desirable from an economic and functional point of view over the apparatus described in U.S. Pat. No. 4,671,721. These and other objects and advantages of the present invention will become more apparent from the following detailed description when taken into conjunction with the attached drawings.

DETAILED DESCRIPTION OF THE PREFERRED EMBODIMENT

Figure 1:
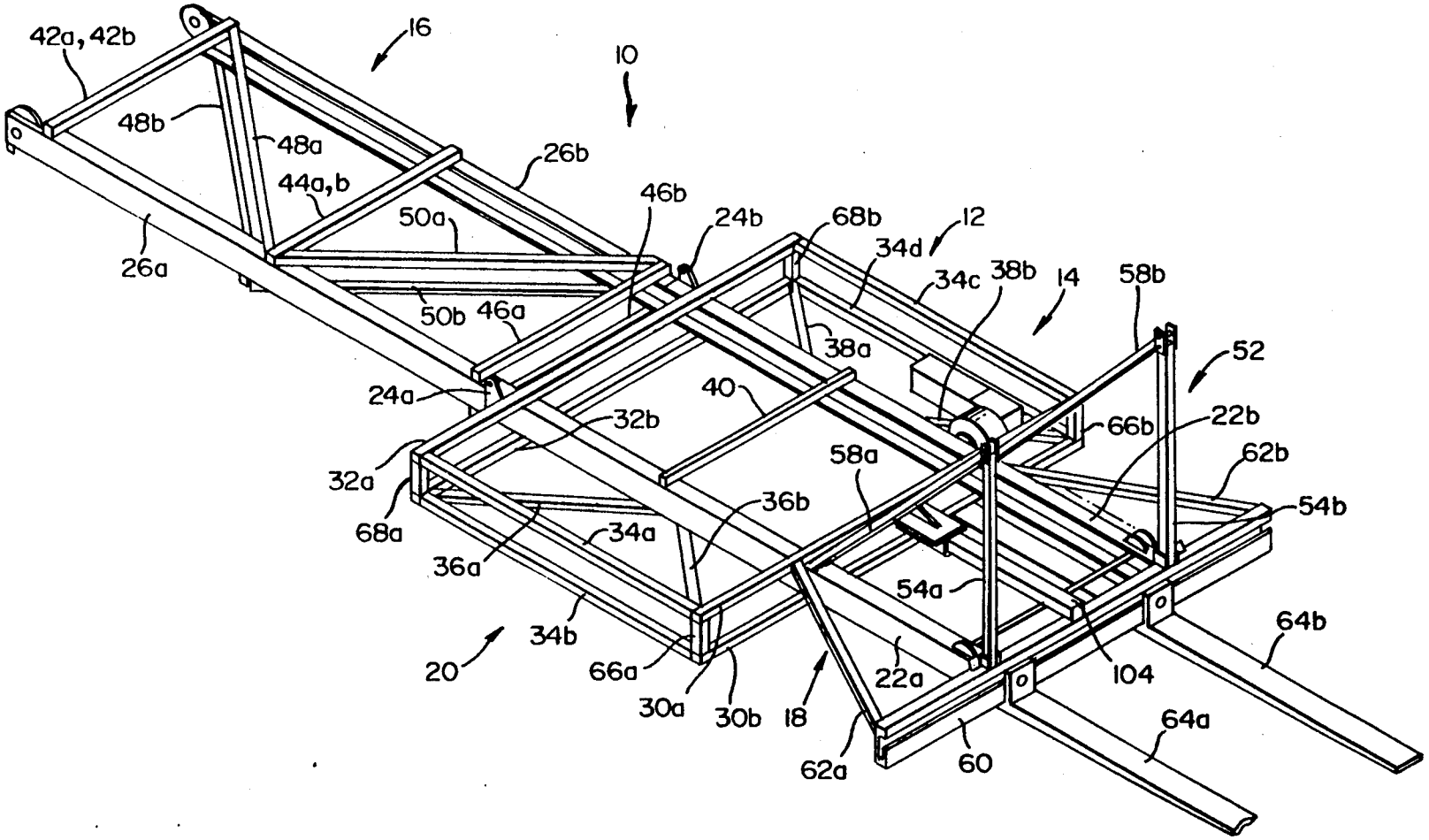
FIG. 1 is an isometric drawing showing the apparatus of the present invention.
Figure 2:
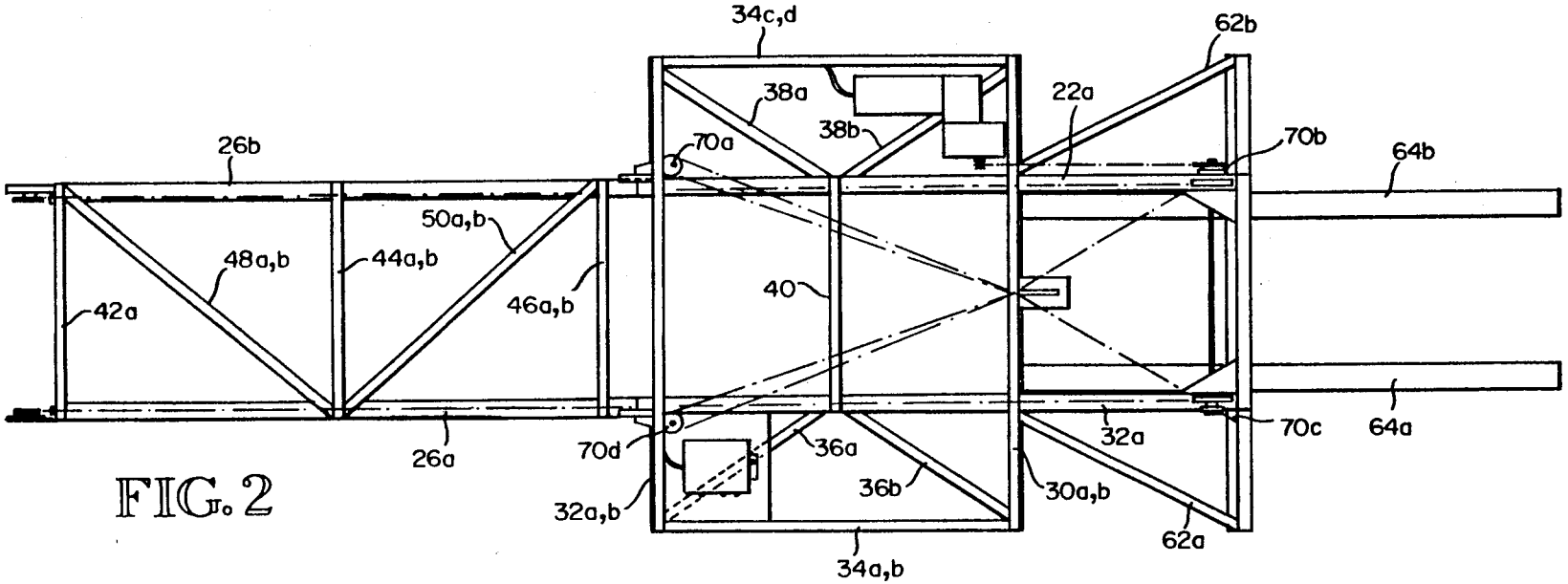
FIG. 2 is a plan view of the apparatus of the present invention.
Figure 3:
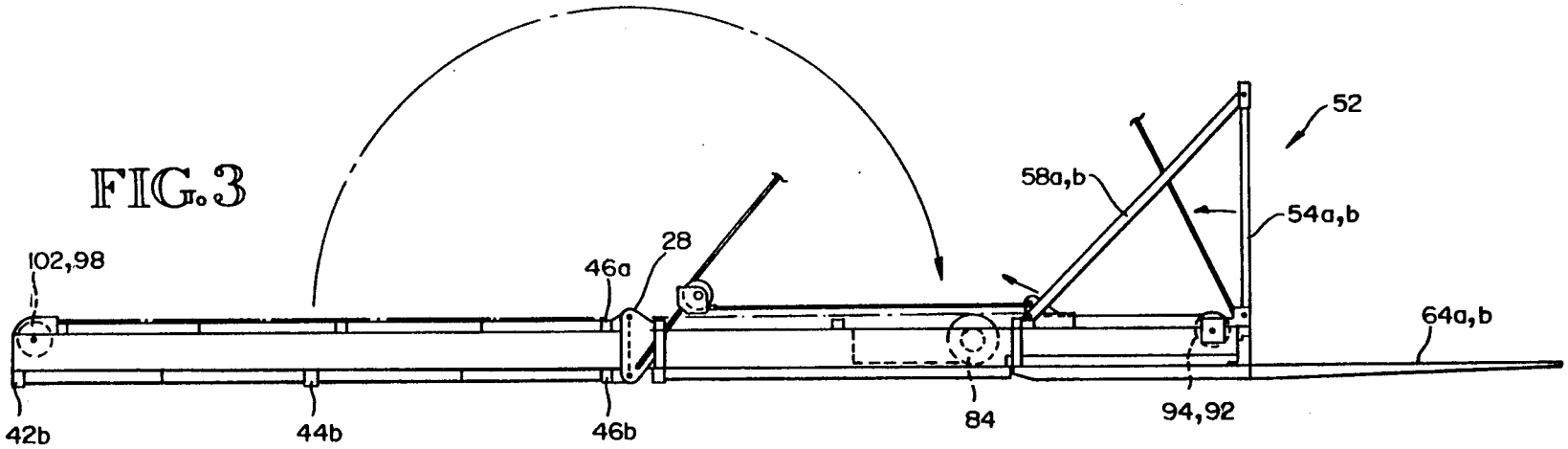
FIG. 3 is a side elevation view of the apparatus of the present invention.
Figure 4:
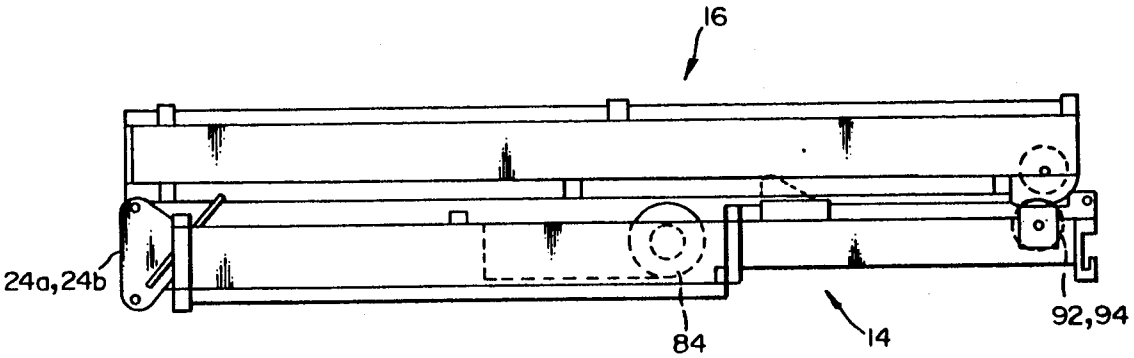
FIG. 4 is a side elevation of the apparatus in the fold position.

Referring to FIGS. 1, 2 and 3, the invention can be described. A forklift, generally designated as 10, is shown having a frame 12. Frame 12 has a head section 14 and a tail section 16. Head section 14 and tail section 16 are approximately equal in horizontal length. Head section 14 has a forward portion 18 of similar dimensions in width to the tail section 16. Head section 14 also has a rear portion 20 which is wider than tail section 16 and the forward portion 18 of head section 14, as best shown in FIG. 1. Head section 14 has a pair of head support beams 22*a* and 22*b* which run the length of head section 14 and are parallel to each other. Head support beams 22*a* and 22*b* are connected through connecting flanges 24*a* and 24*b* to tail support beams 26*a* and 26*b*, respectively. The tail support beams 26*a* and 26*b* are pivotally mounted to head support beams 24*a* and 24*b*, respectively, through a set of pins generally designated as 28. As will be described later, prior to or after use of forklift 10, the tail section 16 can be folded over the head section 14 by removal of suitable pins 28.

The rear portion 20 of head section 14 has a set of cross supports 30*a,b* and 32*a,b*. Rear portion 20 of head section 14 also has length supports 34*a* and 34*b* which connect cross supports 30*a* and 32*a*, and 30*b* and 32*b*, respectively, at one end and length supports 34*c* and 34*d* which connect cross supports 30*a* and 32*a*, and 30*b* and 32*b*, respectively, at the other end. Diagonal head section supports 36*a* and 36*b* connect one end of cross supports 30*b* and 32*b* to head support beam 22*a*. Correspondingly, diagonal head section supports 38*a* and 38*b* connect the other end of cross supports 30*b* and 32*b*, respectively, to head support beam 22*b*. To further stabilize the head support beams 22*a* and 22*b*, a lateral beam support 40 is connected between the head support beams 22*a* and 22*b*. Tail section 16 has a cross bracing system which includes tail cross beams 42*a*, 44*a*, and 46*a*, which connect to tail support beams 26*a* and 26*b* on the top of these beams. In a like manner, tail cross beams 42*b*, 44*b* and 46*b* connect to tail support beam 26*a* and 26*b* on the bottom of these beams. A pair of diagonal tail cross beams 48*a* and 50*a* are also used, connecting at one end to the top of tail support beam 26*a* and at the other end to the top of tail support beam 26*b*. A second pair of diagonal tail cross beams 48*b* and 50*b* connect at the bottom of tail support beams 26*a* and 26*b* as shown best in FIG. 1.

The forward portion 18 of head section 14 has a backstand generally designated as 52 attached thereto. Backstand 52 has a pair of vertical legs 54*a* and 54*b* and backstand diagonal supports 58*a* and 58*b* which connect backstand legs 54*a* and 54*b* to the top of head support beams 22*a* and 22*b*, respectively. The vertical legs 54*a* and 54*b* of backstand 52 connect to a front cross support beam 60 which is mounted partially below the head support beams 22*a* and 22*b*. Diagonal cross braces 62*a* and 62*b* connect between front cross support beam 60 and cross support 30*a*. As best shown in FIGS. 2 and 3, a pair of forks 64*a* and 64*b* fit under front cross support beam 60 and extend rearward contacting the underside of cross support 30*b*. A pair of vertical uprights 66*a* and 66*b* connect cross supports 30*a* and 30*b* of head section 14. It also should be noted that a second pair of vertical uprights 68*a* and 68*b* connect cross supports 32*a* and 32*b* at each of their ends.

Figure 6:
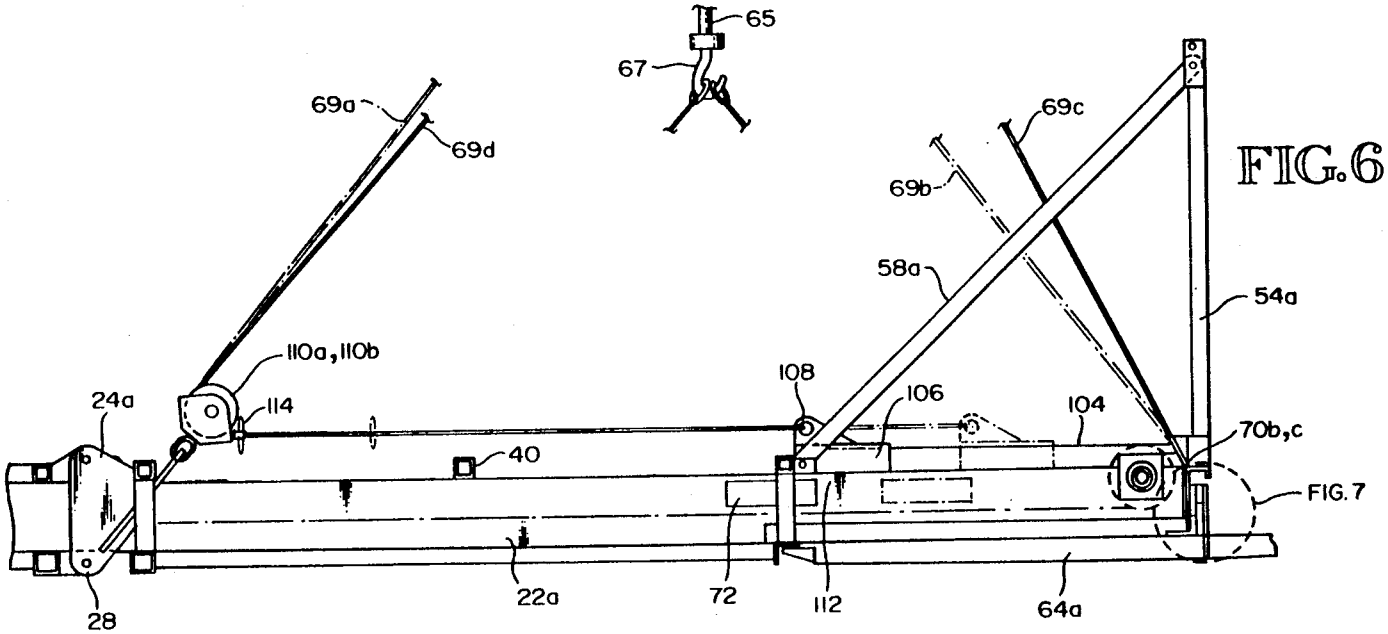
FIG. 6 is a side elevation view of the apparatus of the present invention featuring a sliding flange as part of the leveling system.

The forklift 10 can be grasped by a conventional lifting device (not shown) having a load line 65 and hook 67 (FIG. 6). Cables 69*a,b,c,d* would run from the hook 67 to four "pick" points 70*a,b,c,* and *d*, (FIG. 2) which are prelocated holes in flanges located in the head support beam 22*a* and 22*b*. The center line of the load line 65 is directly over cross support 30*a* and positioned at the midpoint of its length.

Figure 5:
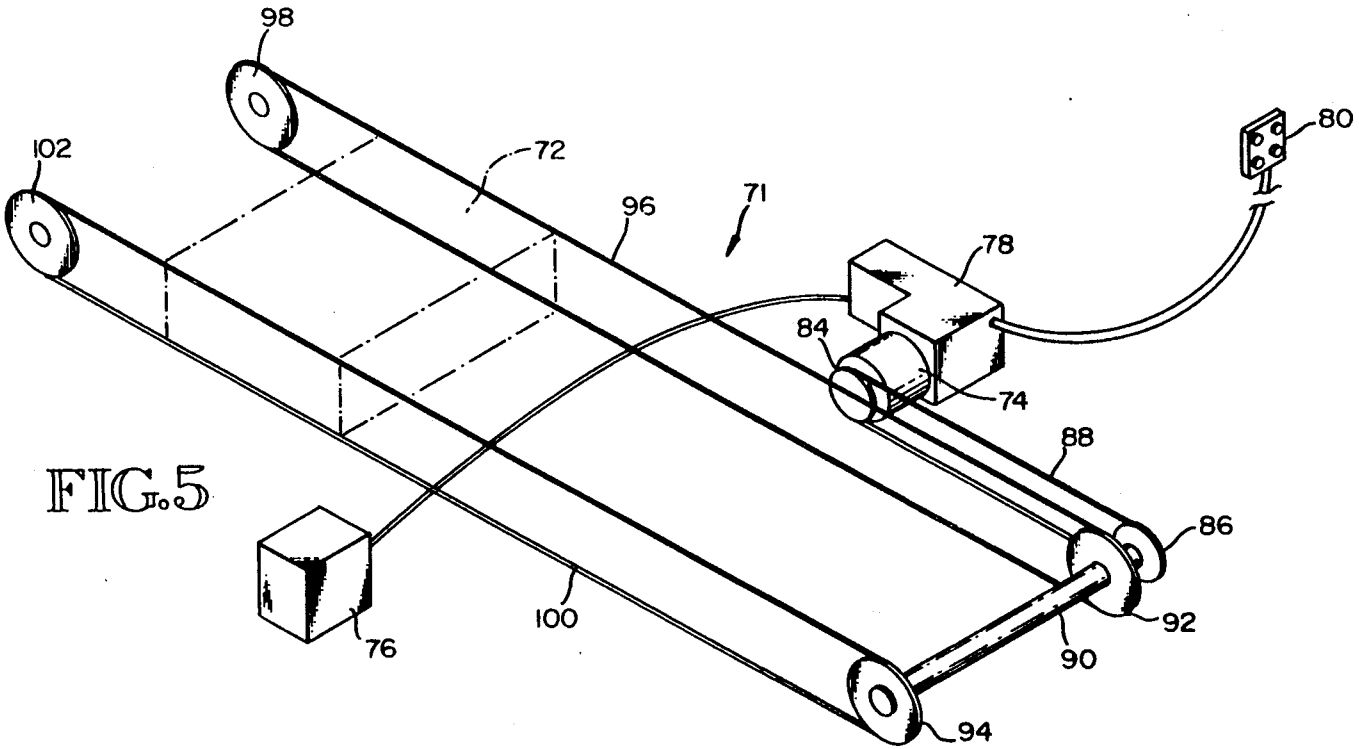
FIG. 5 is an isometric schematic showing counterweight and drive system of the apparatus.

Referring now to FIG. 5, the counterweight and drive system of the apparatus can be described. FIG. 5 shows a leveling system generally designated as 71 with the apparatus. It can be appreciated that as a load is received upon the forks 64*a* and 64*b*, the apparatus would tip toward the end bearing the load. To correct this problem, a counterweight 72 is provided with plastic gibbs (not shown). The plastic gibbs are mounted on the underside of the counterweight 72. Counterweight 72 is a rectangular slab composed of a suitable material such as aluminum. The counterweight 72 is moved back and forth within the tail support beams 26*a* and 26*b* by an electric motor 74 and suitable transmission means subsequently described. The motor 74 is mounted on the part of the frame 12 which overhangs head support beams 22*a* and 22*b*. The motor 74 is therefore supported by diagonal head section supports 38*a* and 38*b*. A generator 76 is connected to the electric motor to provide an electrical input thereto through a switch box 78. The generator 76 preferably is mounted to frame 12, being supported by diagonal head section supports 36*a* and 36*b*. Motor 74 can be activated by a remote switch 80 running from switch box 78. The output shaft of motor 74 is connected to a sprocket 84 which drives a second sprocket 86 through a chain 88. Sprocket 86 is connected to a shaft 90 which is also connected to and drives sprocket 92 and sprocket 94. The shaft 90 is suitably supported by bearings in the head section support beams 22*a* and 22*b* so as to allow support and rotation of that shaft. A second chain 96 is used to connect sprocket 92 and sprocket 98. A third chain 100 is used to connect sprocket 94 mounted on shaft 90 to sprocket 102. Sprockets 98 and 102 are suitably mounted to tail support beams 26*b* and 26*a*, respectively. Each end of chain 100 and chain 96 is connected to the counterweight 72. The net result of this system is that if the output shaft of motor 74 is caused to rotate one way by use of the remote switch 80, the counterweight 72 will be forced rearward within the tail section 16. Use of remote switch 80 causing the output shaft of the motor 74 to rotate in the opposite direction will result in the counterweight to move forward within the tail section 16. The remote switch therefore can cause the counterweight to move and thereby level the apparatus once a load has been received on the-forks 64*a* and 64*b*. The heavier the load, the farther rearward the counterweight 72 will be required to be driven. Once the apparatus is levelled, the remote switch 80 can be placed within the frame 12 and the apparatus and load moved to the desired location into a structure by the lifting device.

Referring to FIG. 6, a preferred feature of the apparatus can be described. Initially, it must be kept in mind that the apparatus for lifting objects into structures herein described has as one of its objects to be as lightweight and compact as possible while able to transmit a load of a given weight. In other words, a high priority in reducing overall length and weight of the apparatus exists.

FIG. 6 illustrates a feature of the invention for improving levelling adjustability for receiving objects. FIG. 6 shows a beam 104 mounted lengthwise between cross support 30*b* of head section 14 and front cross support beam 60. Mounted on this beam 104 is a sliding flange 106. Sliding flange 106 is mounted with plastic bearings on a rail (not shown) which is placed over beam 104 and allows flange 106 to slide fore and aft relative to the apparatus. Sliding flange 106 has an eyehole 108 which receives the rear cables 69*a* and 69*b* of the apparatus. The two rear cables 69*a* and 69*d* from the apparatus are fed through a pair of pulleys 110*a* and 110*b* located at "pick points" 70*a* and 70*d* before being fastened to eyehole 108 of sliding flange 106. The front cables 69*b* and 6*c* are held by the lifting device and attach to pick points 70*b* and 70*c*. A lip 112 is located on the underside of sliding flange 106 which can be contacted by the fore end of the counterweight 72 when the counterwieght 72 is moved to a position closest to the head of this apparatus. The counterweight 72, therefore, can cause the sliding flange 106 to move toward the head of the apparatus. The sliding flange would draw the rear cables 69*a* and 69*d* with it, effectively shifting the center of gravity of the apparatus forward with-respect to the crane. The length of cable from the pulleys 110*a* and 110*b* to the eyehole 108 of the sliding flange 106 would obviously be increased at the reduction of the length of cable from the hook 67 of the lifting device to pulleys 110*a* and 110*b* causing the above mentioned shift in center of gravity. In the no load situation, therefore, the apparatus can be held level without sacrificing additional length, weight or load capacity. Once the forks 64*a* and 64*b* receive a load, the counterweight 72 can be caused to move rearward as previously described to balance that load. The length of cable between the pulleys 110*a*, 110*b* and the eyehole 108 of the sliding flange 106 thereby decreases until a preset stop 114 is reached. The apparatus would then be operated as previously described herein.

Figure 7:
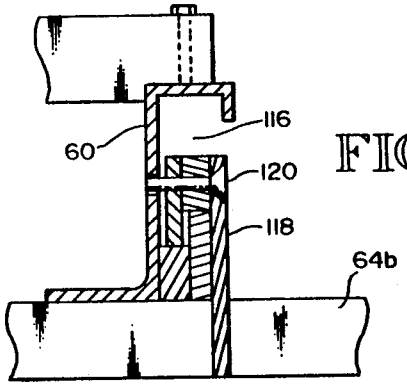
FIG. 7 is a fragmentary side elevation view illustrating the connection of the forks to the frame of the apparatus.

FIG. 7 shows a detail of the forks 64*a* and 64*b* used with the present apparatus. It should be noted that conventional cantilevered forks if used with the present invention would present problems. The forks used in conjunction with the present invention preferably should be functional, i.e., capable of supporting the loads carried by the apparatus, yet detachable so as to reduce the overall size of the apparatus during transportation. To accomplish these objects, the cross support beam 60 has a channel 116 which is adapted to receive a flange 118 located in the mid-portion of forks 64*a* and 64*b*. The flange 118 of each fork interlocks with the channel 116 of the cross support beam 60. To further bear the load on the forks 64*a* and 64*b*, the rear-most end of the forks fits under cross support 30*b* thereby bracing the forks and distributing the load thereon in a workable manner. In practice, the flanges 118 of forks 64*a* and 64*b* could be fastened with bolts 120 or detachably pinned to the channel 116. Removal of the forks 64*a* and 64*b* after use of the apparatus would require only the withdrawing of bolts 120 or suitable pins (not shown) through the flanges 118 and channel 116. It also should be noted that the sideways distance between the forks can be adjusted in an obvious manner to accommodate a variety of loads.

After operation of the apparatus, the entire apparatus can be completely folded for storage or transportation purposes. To do this, initially the forks 64*a* and 64*b* would be removed as described immediately above. The forks 64*a* and 64*b* could be temporarily attached to head support beams 22*a* and 22*b* by flanges appropriately located on those beams (not shown). The backstand 52 can be folded in a manner best shown in FIG. 3. The rearmost end of the backstand supports 58*a, b* relative to the apparatus can be detached from head support beams 22*a* and 22*b* by removal of suitable pins. Backstand diagonal supports 58*a* and 58*b* are rotably connected to backstand legs 54*a* and 54*b*, respectively. When the suitable pins are removed, the supports 58*a, b* can be slid along the top of the head support beam 22*a* and 22*b* causing the entire backstand 52 to lie flat on top of support beams 22*a* and 22*b*. With the forks 64*a, b* tucked away and the backstand flat, tail section 16 can be folded over head section 14. To accomplish this folding, the bottom pins 28 are removed and the tail section 16 rotated in a manner illustrated in FIG. 3 allowing the tail section 16 to lie on top of the head section 14. The apparatus can thereby be conveniently stored or transported.

The invention may be embodied in other forms without departing from the spirit or essential characteristics thereof. The present embodiments are therefore to be considered in all respects as illustrative and not restrictive, the scope of the invention being indicated by the appended claims rather than the foreging description, and all change which comes within the meaning and range of equivalency of claims are intended to be embraced therein.

What we claim is:

1. Apparatus for supporting and lifting an object comprising:

a. a frame having a head section and a tail section, said head section rotatably mounted to said tail section so that said head section can be folded over said tail section prior to use of the apparatus, said head section being wider than said tail section;

b. a backstand attached to said head section, said backstand having a substantially vertical member identified as a first vertical member and a second support member attached to the top end of said first vertical member and to the head section;

c. support means directed outwardly from said head section and secured below said head section for receiving and supporting objects thereon;

d. leveling means mounted on said frame for leveling said frame in a horizontal direction when said support means receives and supports objects thereon, said leveling means including a motor connected to a counterweight, said counterweight connected to said motor so as to keep said frame level in the horizontal direction when objects are received by said support means; and e. lifting means connected to said frame for lifting said frame and object.

2. The apparatus of claim 1 where the second support member of said backstand can be disconnected from said head section, and said vertical member and said support member can be folded down over said head section when the apparatus is not in use.

3. The apparatus of claim 1 wherein said head section and said tail section have two adjacent inner support beams.

4. Apparatus for supporting and lifting an object comprising:

a. a frame having a head section and a tail section, said head section rotatably mounted to said tail section so that said tail section can be folded over said head section prior to use of the apparatus, said head section being wider than said tail section;

b. support means directed outwardly from said head section and secured below said head section for receiving and supporting objects thereon;

c. leveling means mounted on said frame for leveling said frame in a horizontal direction when said support means receives and supports objects thereon, said leveling means including a motor connected to a counter weight, said counterweight connected to said motor so as to keep said frame level in the horizontal direction when objects are received by said support means; and d. lifting means connected to said frame for lifting said frame and object.

5. The apparatus of claim 4 which includes a backstand attached to said head section, said backstand having a substantially vertical member identified as a first vertical member and a second support member attached to the top end of said first vertical member and to the head section.

6. The apparatus of claim 5 wherein the second support member of said backstand can be disconnected from said head section, and said vertical member and said support member can be folded down over said head section when the apparatus is not in use.

7. The apparatus of claim 4 wherein said head section and said tail section have two adjacent inner support beams.

8. The apparatus of claim 7 wherein said counterweight is connected to said motor by transmission means, said transmission means includes a sprocket and chain.

9. Apparatus for supporting and lifting an object comprising:

a. a folding frame having a head section and a tail section, said head section mounted to said tail section so as to allow said frame to be in a first position wherein said tail section is positioned over said head section prior to the use of said apparatus, said head section mounted to said tail section so as to allow said frame to open into a section position wherein said head section and said tail section are co-planar during use of said apparatus;

b. fork means directed outwardly from said head section for receiving and supporting objects thereon;

c. leveling means mounted on said frame for leveling said frame in a horizontal direction when said fork means receives and supports objects thereon; and d. lifting means connected to said frame for lifting said frame and object.

10. The apparatus of claim 9 which includes a backstand attached to said head section, said backstand having a substantially vertical member identified as a first vertical member and a second support member attached to the top end of said first vertical member and to the head section.

11. The apparatus of claim 10 wherein the second support member of said backstand can be disconnected from said head section, and said vertical member and said support member can be folded down over said head section when the apparatus is not in use.

12. The apparatus of claim 9 wherein said leveling means includes a motor connected to a counterweight, said motor mounted in said head section and said counterweight, said motor mounted in said head section and said counterweight connected to said motor by sprocket and chain means, said counterweight being caused to move in the horizontal direction so as to keep said frame level with respect to the horizontal direction when objects are received by said fork means.

13. The apparatus of claim 12 wherein said head section and said tail section have two adjacent inner support beams, said sprocket and chain means being located above said inner support beams.

14. The apparatus of claim 9 wherein said fork means has a front portion, a mid-portion and a rear portion and is interlockingly connected to said head section at said mid-portion, whereby the rear portion of said fork means fits under said head section and contacts said head section.

15. The apparatus of claim 1 wherein said lifting means includes a lifting device with cables extending therefrom to said frame, and said leveling means includes a sliding member responsive to movement of said counterweight whereby movement of said sliding member in the horizontal direction causes an adjustment in said cables of said lifting device thereby keeping said frame level with respect to the horizontal direction prior to said support means receiving objects.

16. The apparatus of claim 4 wherein said lifting means includes a lifting device with cables extending therefrom to said frame, and said leveling means includes a sliding member responsive to movement of said counterweight whereby movement of said sliding member in the horizontal direction causes an adjustment in said cables of said lifting device thereby keeping said frame level with respect to the horizontal direction prior to said support means receiving objects.

17. The apparatus of claim 12 wherein said lifting means includes a lifting device with cables extending therefrom to said frame, and said leveling means includes a sliding member responsive to movement of said counterweight whereby movement of said sliding member in the horizontal direction causes an adjustment in said cables of said lifting device thereby keeping said frame level with respect to the horizontal direction prior to said fork means receiving objects.

18. The apparatus of claim 9 wherein said fork means are adjustable in a direction sideways to the apparatus.

* * * * *